US009144952B2

(12) United States Patent
Oshima

(10) Patent No.: US 9,144,952 B2
(45) Date of Patent: Sep. 29, 2015

(54) SHUTTER FOR SHEET PROCESSING APPARATUS

(71) Applicant: Keisuke Oshima, Yokohama (JP)

(72) Inventor: Keisuke Oshima, Yokohama (JP)

(73) Assignee: KONICA MINOLTA, INC. (JP)

( * ) Notice: Subject to any disclaimer, the term of this patent is extended or adjusted under 35 U.S.C. 154(b) by 86 days.

(21) Appl. No.: 13/860,915

(22) Filed: Apr. 11, 2013

(65) Prior Publication Data

US 2013/0272818 A1 Oct. 17, 2013

(30) Foreign Application Priority Data

Apr. 12, 2012 (JP) ..... 2012-090808

(51) Int. Cl.

| | |
|---|---|
| ***B65H 37/04*** | (2006.01) |
| ***B31F 1/00*** | (2006.01) |
| ***B42C 1/00*** | (2006.01) |
| ***B65H 29/00*** | (2006.01) |
| ***B65H 39/10*** | (2006.01) |

(52) U.S. Cl.

CPC ..... *B31F 1/0003* (2013.01); *B42C 1/00* (2013.01); *B65H 29/00* (2013.01); *B65H 39/10* (2013.01); *B65H 2402/443* (2013.01); *B65H 2402/45* (2013.01); *B65H 2407/11* (2013.01); *B65H 2407/50* (2013.01); *B65H 2701/1932* (2013.01)

(58) Field of Classification Search

CPC ..... B65H 37/04
USPC ..... 270/58.08, 58.09, 58.11, 58.12, 58.13
See application file for complete search history.

(56) References Cited

U.S. PATENT DOCUMENTS

| | | | | |
|---|---|---|---|---|
| 4,887,060 | A | 12/1989 | Kaneko | |
| 7,104,538 | B1 * | 9/2006 | Kimura et al. | 271/291 |
| 7,837,186 | B2 * | 11/2010 | Taki et al. | 270/58.09 |
| 7,950,642 | B2 * | 5/2011 | Taki et al. | 270/37 |
| 7,984,900 | B2 * | 7/2011 | Terao et al. | 270/58.12 |
| 8,028,984 | B2 * | 10/2011 | Taki et al. | 270/58.09 |
| 2003/0067106 | A1 | 4/2003 | Mizuta et al. | |

(Continued)

FOREIGN PATENT DOCUMENTS

| | | | |
|---|---|---|---|
| JP | 63034691 | A | 2/1988 |
| JP | S63034691 | A | 2/1988 |
| JP | S63101259 | A | 6/1988 |

(Continued)

OTHER PUBLICATIONS

Notification of Reasons for Refusal for the Japanese patent application No. 2012-090808 mailed on Apr. 22, 2014. English translation attached.

(Continued)

*Primary Examiner* — Patrick Mackey
(74) *Attorney, Agent, or Firm* — Cantor Colburn LLP

(57) ABSTRACT

A sheet processing apparatus, including a sheet processing section which performs predetermined processing on sheets of paper to form a booklet; a booklet ejection section which nips the booklet and ejects the booklet outside; an ejected paper stacking section on which the booklet ejected by the booklet ejection section is stacked; a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected.

6 Claims, 14 Drawing Sheets

(56) References Cited

U.S. PATENT DOCUMENTS

| | | | | |
|---|---|---|---|---|
| 2010/0117287 | A1* | 5/2010 | Terao et al. | 270/58.08 |
| 2013/0108344 | A1* | 5/2013 | Kimura | 399/410 |

FOREIGN PATENT DOCUMENTS

| | | | |
|---|---|---|---|
| JP | 1137949 | U | 9/1989 |
| JP | 09156820 | A | 6/1997 |
| JP | 2002-87693 | A | 3/2002 |
| JP | 2003081513 | A | 3/2003 |
| JP | 2006021886 | A | 1/2006 |
| JP | 2011057441 | A | 3/2011 |

OTHER PUBLICATIONS

Japanese Office Action "Notification of Reasons for Refusal", regarding Patent Application No. 2012-090808; Date of Mailing: Aug. 5, 2014, with English translation.

* cited by examiner

SHUTTER FOR SHEET PROCESSING APPARATUS

CROSS REFERENCE TO RELATED APPLICATIONS

The present invention claims priority under 35 U.S.C. §119 to Japanese Application No. 2012-090808 filed Apr. 12, 2012, the entire content of which is incorporated herein by reference.

BACKGROUND OF THE INVENTION

1. Field of the Invention

The present invention relates to a sheet processing apparatus and an image forming system.

2. Description of Related Art

Conventionally, a sheet processing apparatus is configured so that a predetermined number of paper sheets on each of which an image is formed by an image forming apparatus are stacked to be matched, folded, bound, trimmed and such like to form a booklet, and the formed booklet is ejected outside (for example, Japanese Patent Application Laid Open Publication No. 2002-87693).

In such sheet processing apparatus, the booklets formed by performing various types of processing on the sheets are nipped by a pair of rollers in a booklet ejection section and ejected out of the sheet processing apparatus, and the plurality of booklets ejected by the booklet ejection section are stacked on an ejected paper stacking section.

However, in such conventional sheet processing apparatus as described above, an open part is provided at a housing to eject the booklets processed by the predetermined processing to the ejected paper stacking section which is provided outside the housing of the sheet processing apparatus, and the booklet ejection section is exposed at the open part. Though there is no specific problem during ejection of the booklets since the booklets are covering the open part, at the rest of the time, such as when the ejected booklets are inspected and when maintenance is performed on the sheet processing apparatus, for example, foreign substances such as tools and components may come into the booklet ejection section from the ejected paper stacking section side. It is not preferable that the foreign substances come into the booklet ejection section because the apparatus itself becomes damaged or causes false operation.

SUMMARY OF THE INVENTION

Thus, at least an embodiment of the present invention provides a sheet processing apparatus and an image forming system which can prevent the entrance of foreign substances into the booklet ejection section from the ejected paper stacking section side.

In order to achieve the above, according to one aspect of the present invention, there is provided a sheet processing apparatus, including a sheet processing section which performs predetermined processing on a sheet of paper to form a booklet; a booklet ejection section which nips the booklet and ejects the booklet outside; an ejected paper stacking section on which the booklet ejected by the booklet ejection section is stacked; a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected.

Preferably, the shutter section includes a booklet feed roller which abuts an upper surface of the booklet ejected from the booklet ejection section and pushes the booklet.

Preferably, the opening and closing mechanism performs the opening and closing operation in conjunction with drive of the booklet ejection section.

Preferably, the opening and closing mechanism includes a cam which operates in accordance with the drive of the booklet ejection section and a cam follower which is fixed on the shutter section and slidably contacts with the cam, and the opening and closing operation is performed by the cam follower sliding on the cam following the operation of the cam.

Preferably, the opening and closing mechanism includes a driving section which drives the shutter section, a detection section which detects ejection of the booklet and a control section which performs the opening and closing operation by driving the shutter section with the driving section on the basis of a timing at which ejection of the booklet is detected by the detection section.

According to the other aspect of the present invention, there is provided an image forming system, including an image forming apparatus which forms an image on a sheet of paper; and the sheet processing apparatus which performs predetermined processing on the sheet on which the image is formed by the image forming apparatus.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings. Though various technical limitations which are preferable to perform the present invention are added to the after-mentioned embodiment, the scope of the invention is not limited to the following embodiment and the illustrated examples.

Figure 1:
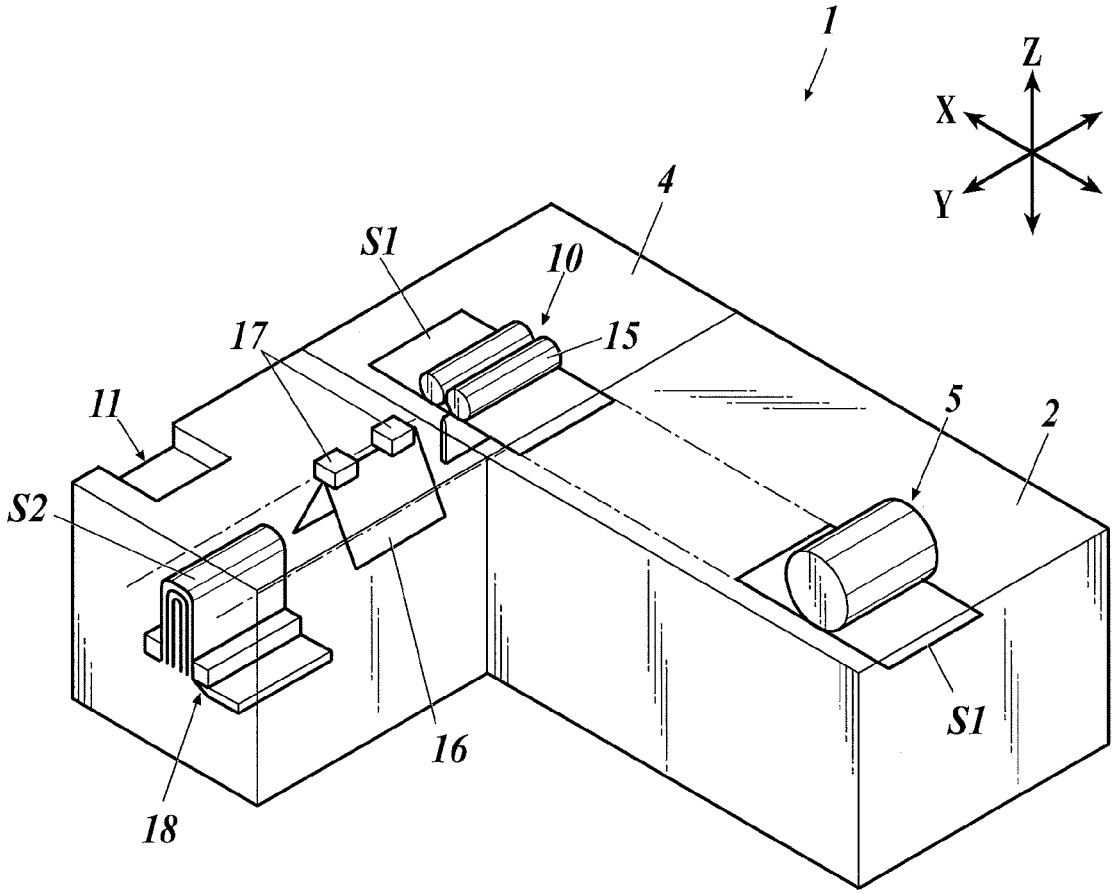
FIG. 1 is a schematic perspective view showing an overall configuration of an image forming system.

An image forming system 1 will be described with reference to FIG. 1. FIG. 1 is a schematic perspective view showing an overall configuration of the image forming system 1.

The image forming system 1 includes an image forming apparatus 2 and a sheet processing apparatus 4.

Hereinafter, the vertical direction is referred to as Z direction, a direction along with the connecting direction between the image forming apparatus 2 and the sheet processing apparatus 4 shown in FIG. 1 is referred to as X direction and the direction orthogonal to the X direction and the Z direction is referred to as Y direction.

The image forming apparatus 2 forms an image on a paper sheet S1.

Specifically, for example, the image forming apparatus 2 includes a conveyance section which draws a sheet S1 stocked as a recording medium from a sheet tray and conveys the sheet S1, a development section which develops a toner image corresponding to bitmap data onto a first transfer member such as a transfer roller, a first transfer section which transfers the toner image developed on the first transfer member onto a second transfer member such as a transfer drum 5, a second transfer section which transfers the toner image transferred on the second transfer member onto the sheet S1 conveyed by the conveyance section, a fixing section which fixes the transferred toner image on the sheet S1, an ejection section which ejects the sheet S1 after fixing processing by the fixing section and others to form an image on the sheet S1.

The image forming apparatus 2 passes the ejected paper S1 on which the image is formed to the sheet processing apparatus 4.

Figure 2:
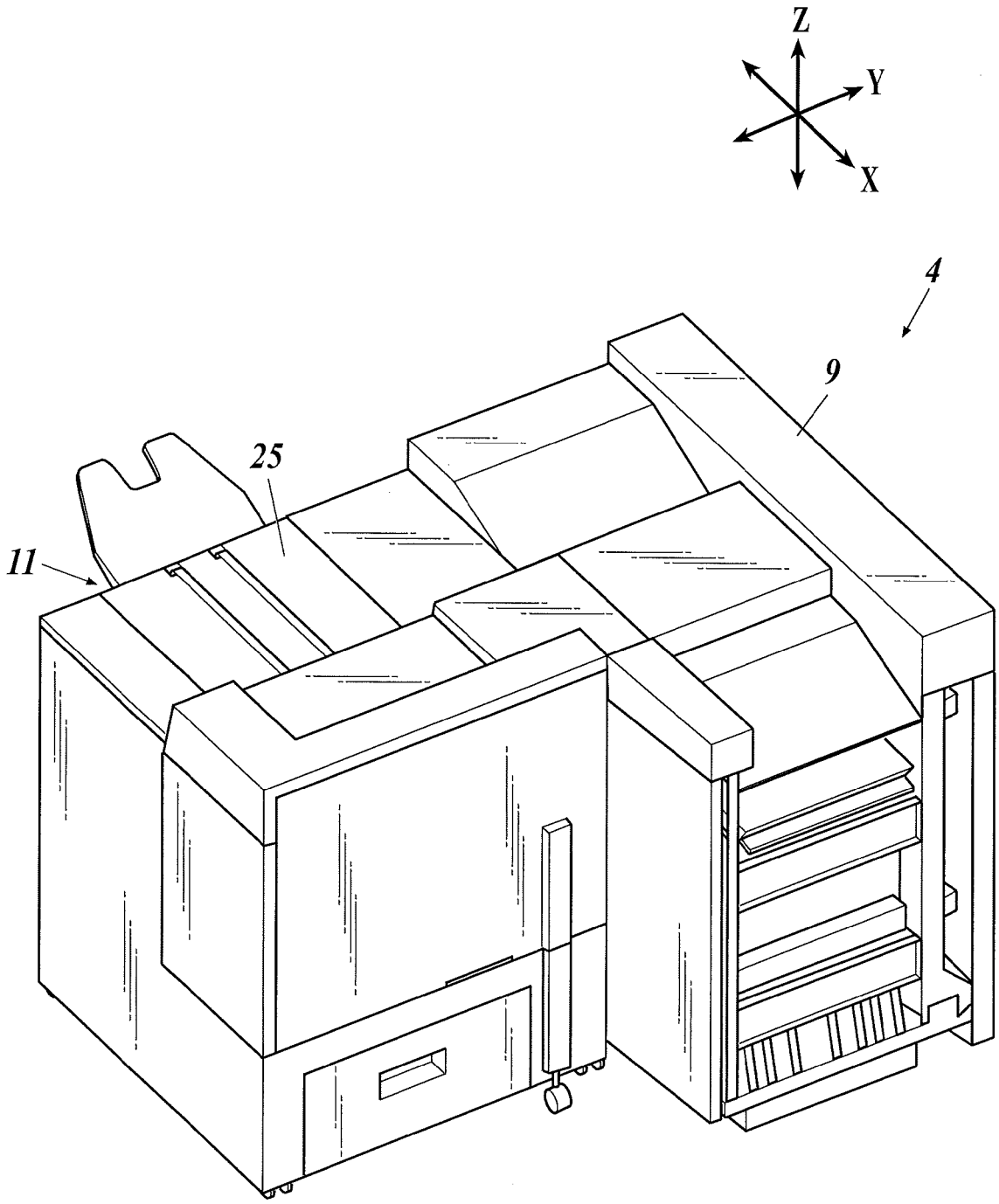
FIG. 2 is a schematic perspective view of a sheet processing apparatus.

Next, the sheet processing apparatus 4 will be described with reference to FIGS. 1 and 2. FIG. 2 is a schematic perspective view showing an overall configuration of the sheet processing apparatus 4.

The sheet processing apparatus 4 performs predetermined processing on the sheet S1 passed from the image forming apparatus 2.

The sheet processing apparatus 4 includes a housing 9 and inside the housing 9, a sheet processing section 10 which performs predetermined processing on the sheet S1 passed from the image forming apparatus 2 to form a booklet S2, a paper ejection section 11 which ejects the booklet S2 formed by the sheet processing section 10 and a control section 12 (see FIG. 9) which controls the sections are provided. At the upper part of the housing 9, an open part 91 is provided for the paper ejection section 11 to eject the booklet S2 out of the housing 9.

The sheet processing section 10 performs middle folding processing to fold the sheet S1 in the middle, middle binding processing to stack and bind a plurality of the middle-folded sheets S1, trimming processing to trim end portions opposite to the folding line of the plurality of middle-bound sheets S1, and such like on the sheet.

Specifically, the sheet processing section 10 includes, for example, a middle folding section 15 which folds the sheet S1 at a predetermined position along a predetermined direction, a hanging section 16 on which a plurality of the sheets S1 folded in the middle by the middle folding section 15 are placed to be stacked, a binding section 17 which strikes binding pins into two positions along the folding direction on the folding line of the plurality of sheets S1 stacked on the hanging section 16, a trimming section 18 which cuts off and trims the end portions opposite to the folding line of the booklet S2 formed by the binding section 17, and others. The booklet S2 formed by the sheet processing section 10 in such configuration is supported and conveyed by a conveyance unit (not shown in the drawings) which is provided under the paper ejection section 11, and passed to the paper ejection section 11 in a state of the folding line being turned up in a nearly vertical direction.

The sheet processing apparatus 4 can also eject the sheets S1, which are passed from the image forming apparatus 2, from the paper ejection section 11 to the outside of the sheet processing apparatus 4 without performing a part or all of the various types of processing by the sheet processing section 10.

Hereinafter, the paper ejection section 11 will be described with reference to FIGS. 3 to 10.

Figure 3:
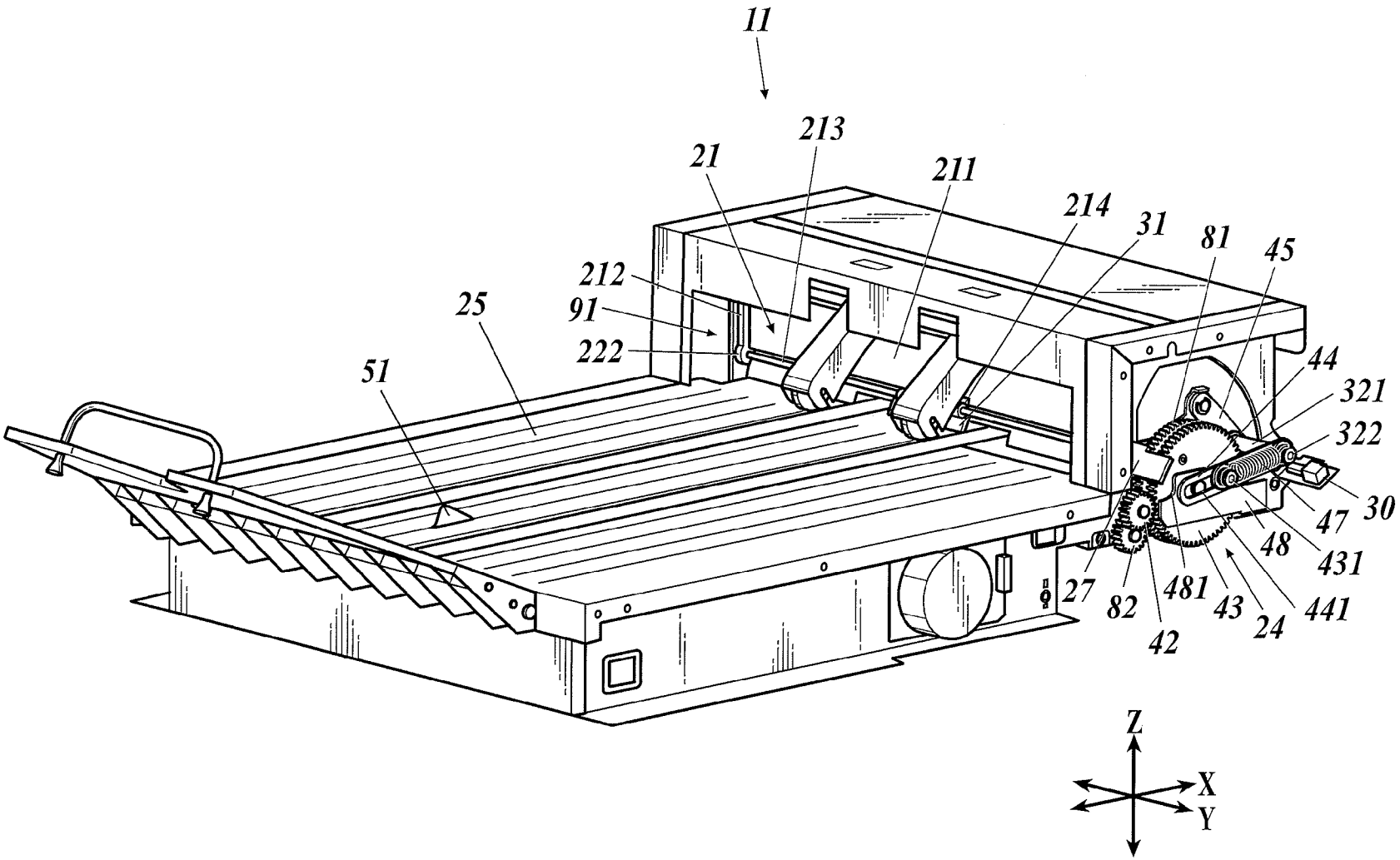
FIG. 3 is a perspective view showing a paper ejection section of a sheet processing apparatus.
Figure 4:
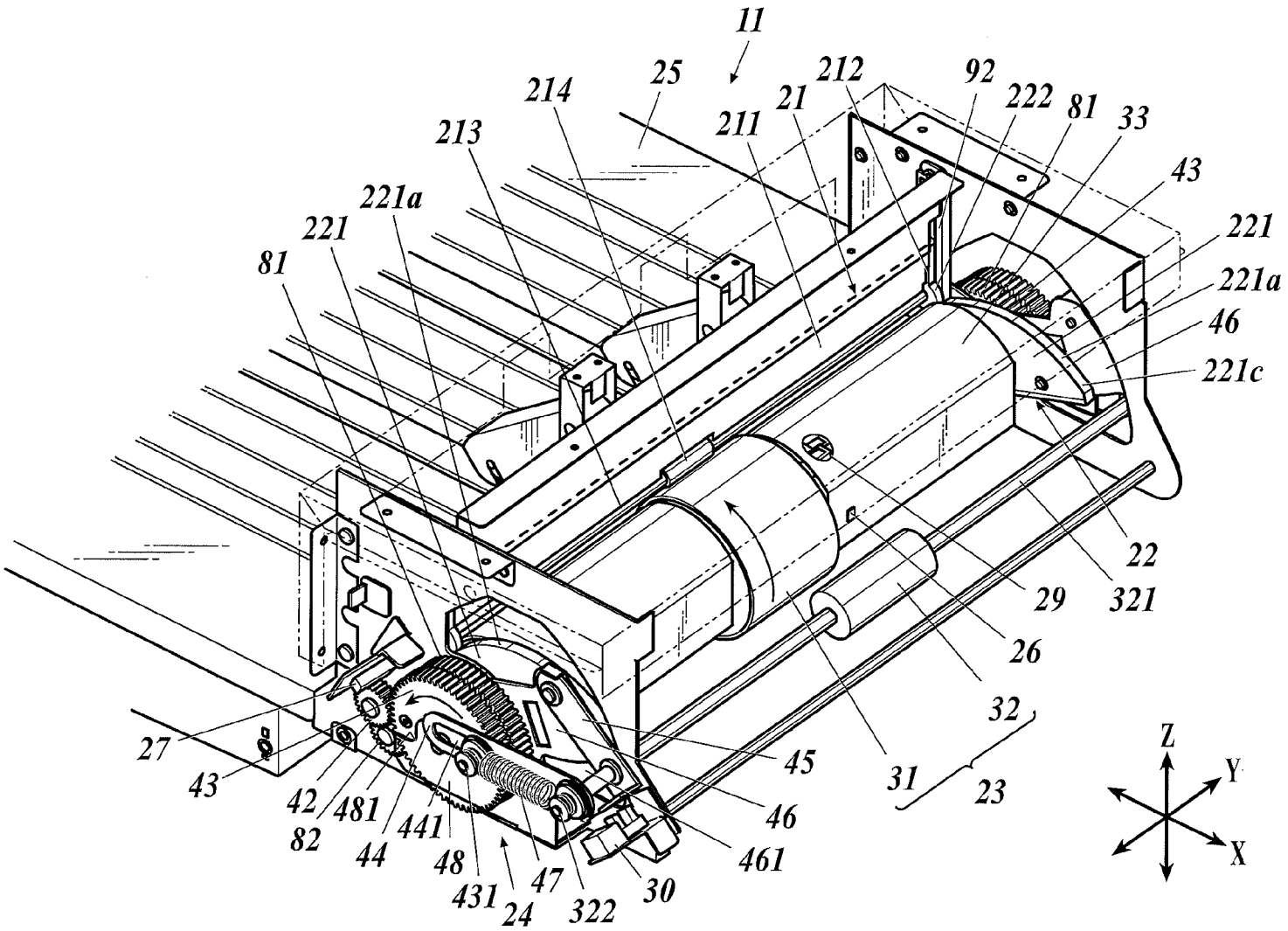
FIG. 4 is a perspective view showing a part of a paper ejection section in a standby state before receiving booklets.
Figure 5:
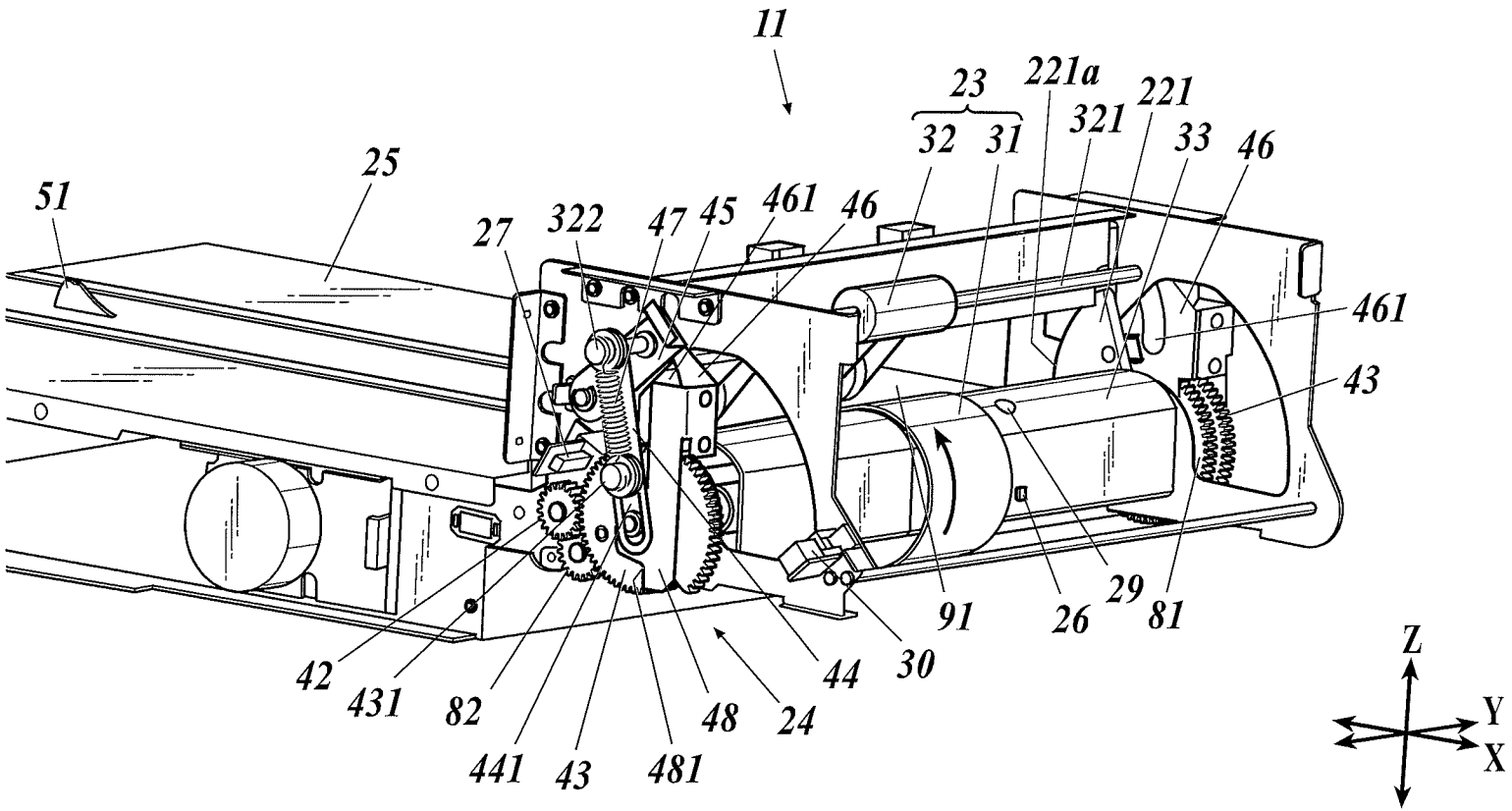
FIG. 5 is a perspective view showing a part of a paper ejection section when ejecting booklets.
Figure 6:
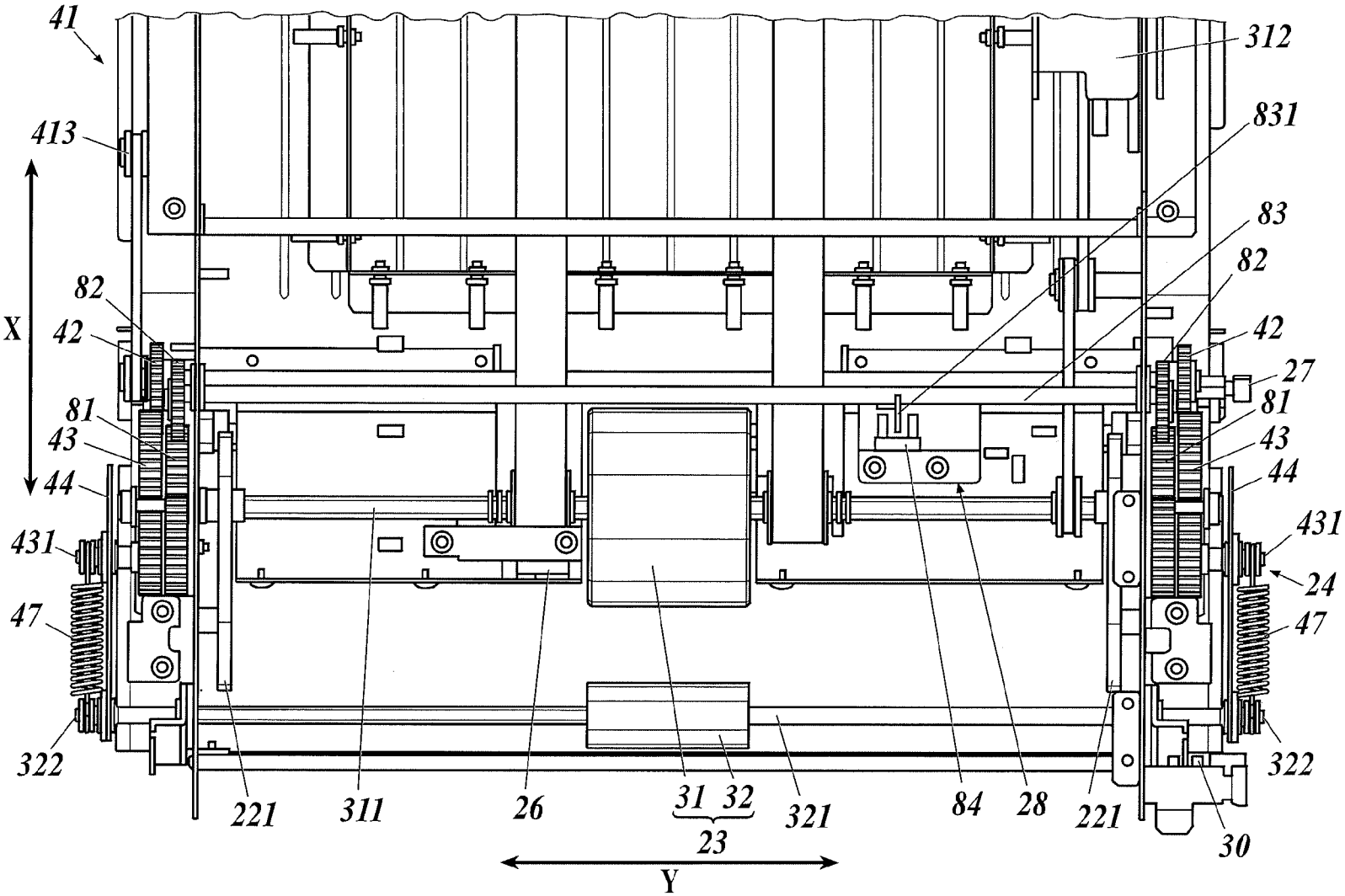
FIG. 6 is a schematic bottom view showing a part of a paper ejection section in a standby state before receiving booklets.
Figure 7:
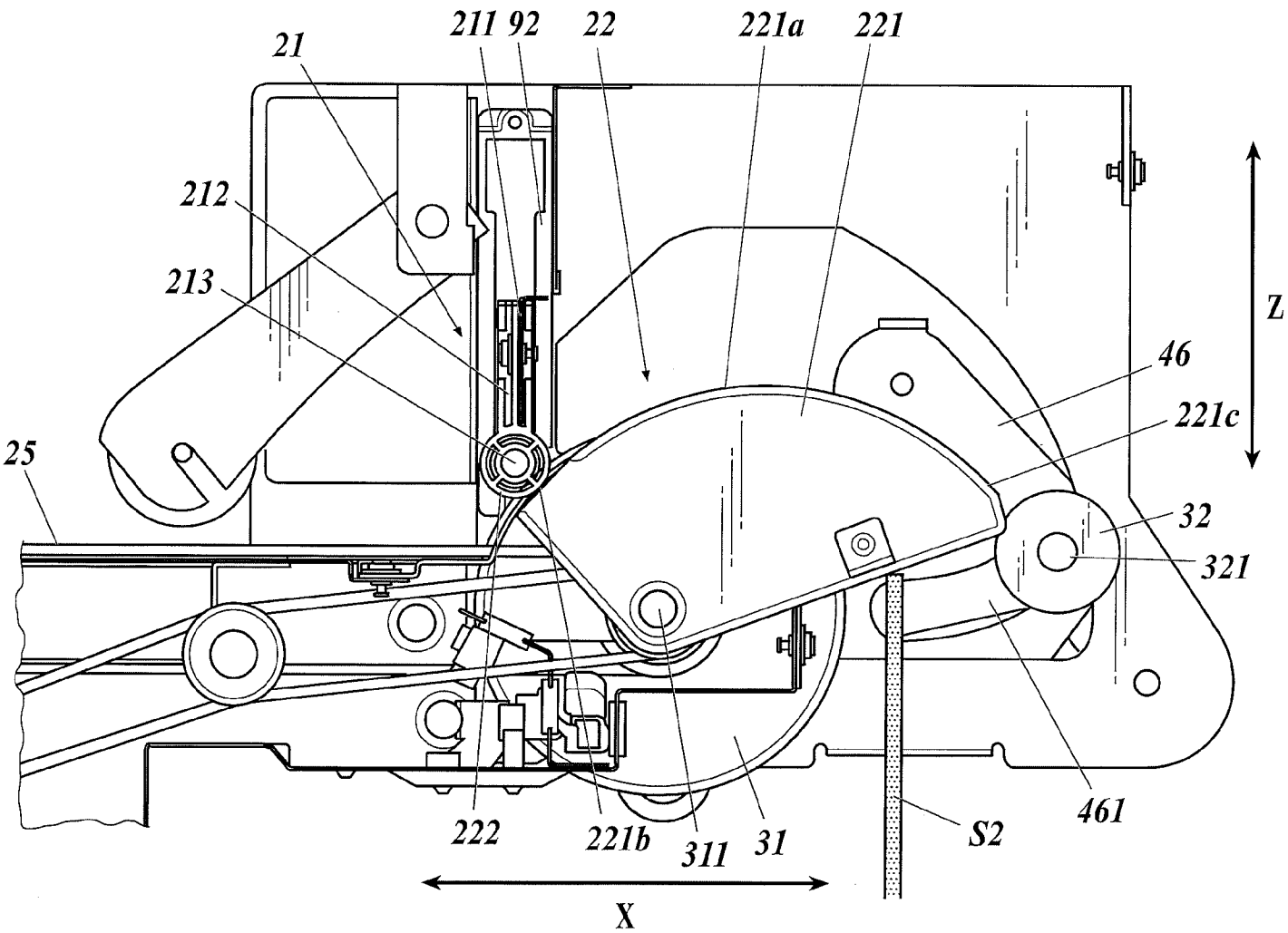
FIG. 7 is a diagram showing a booklet ejection section and an opening and closing mechanism in a standby state before receiving booklets.
Figure 8:
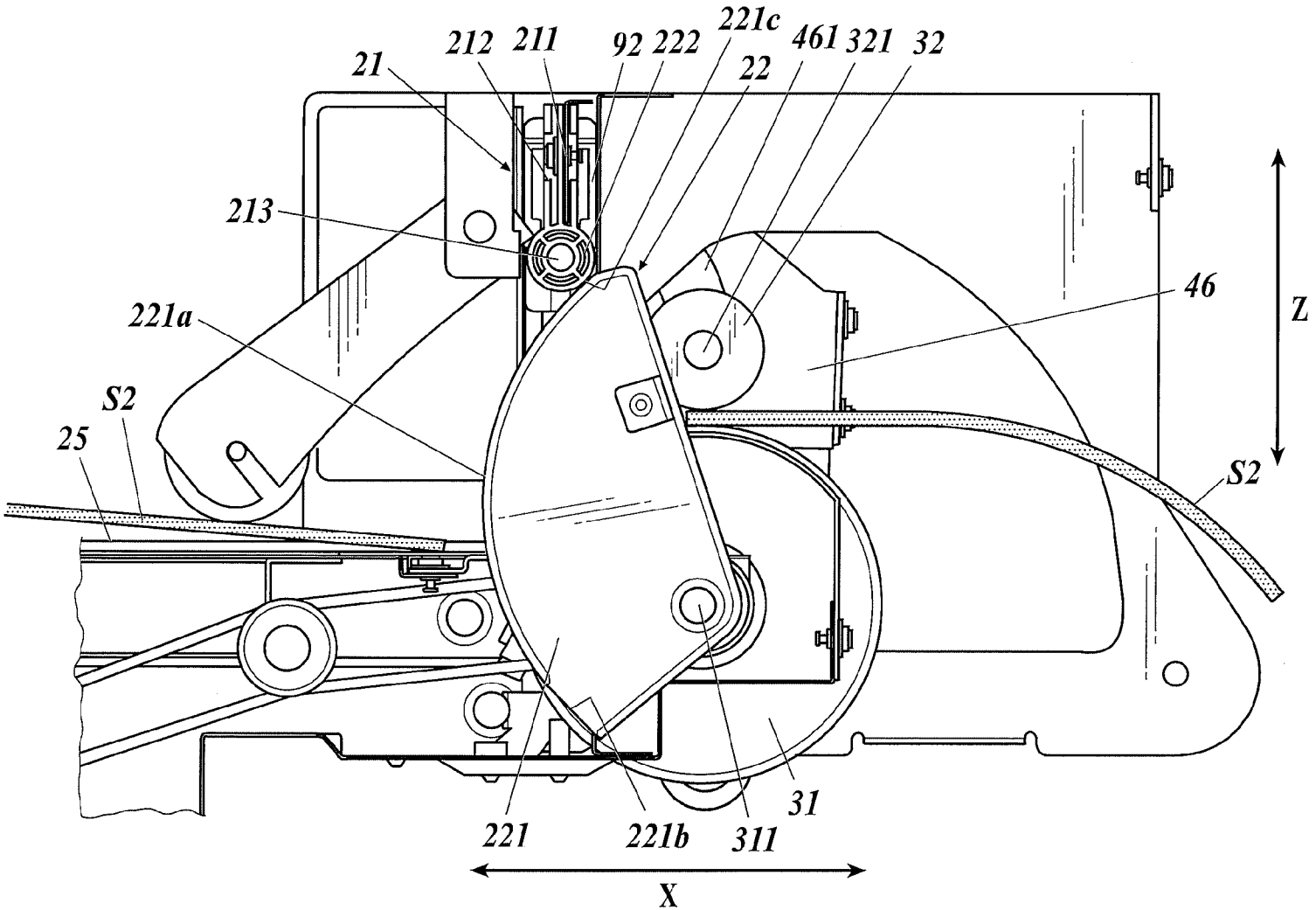
FIG. 8 is a diagram showing a booklet ejection section and an opening and closing mechanism when ejecting booklets.
Figure 9:
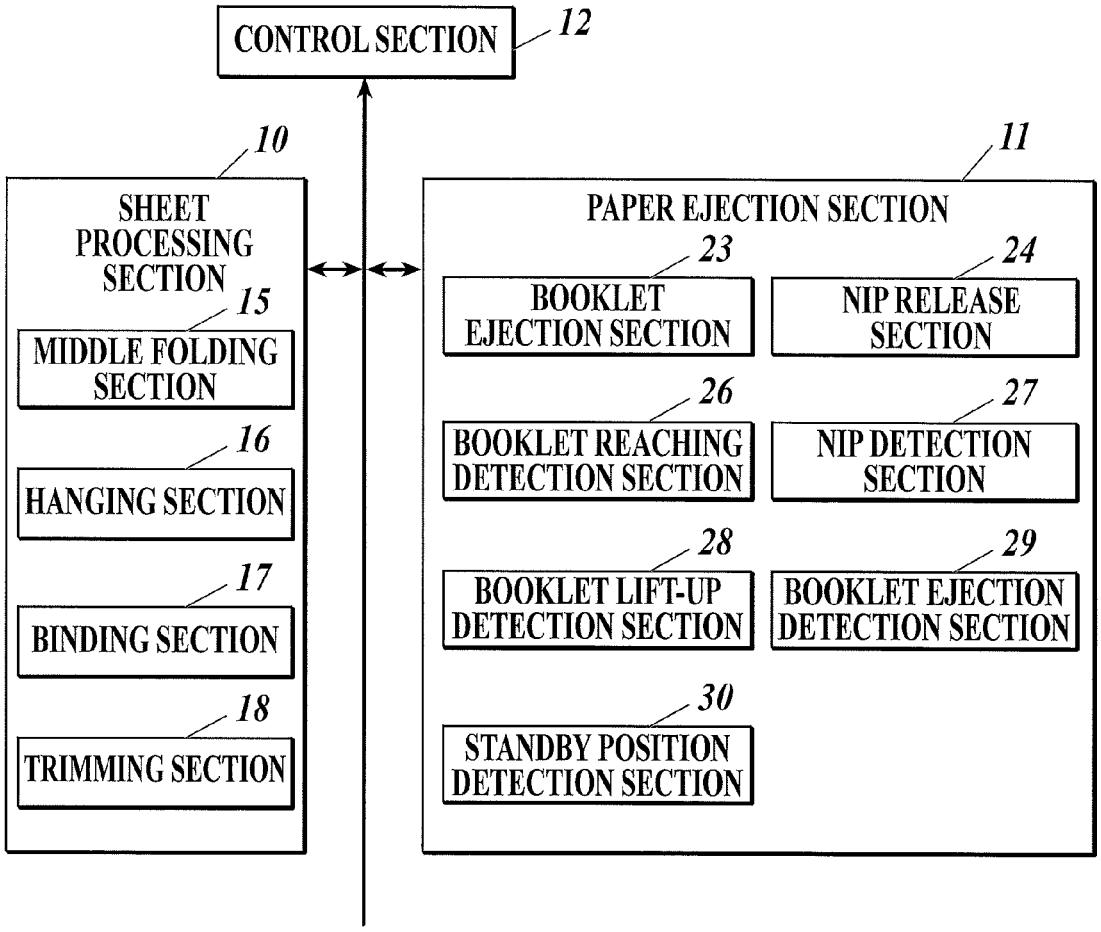
FIG. 9 is a block diagram showing a control system of a sheet processing apparatus.
Figure 10:
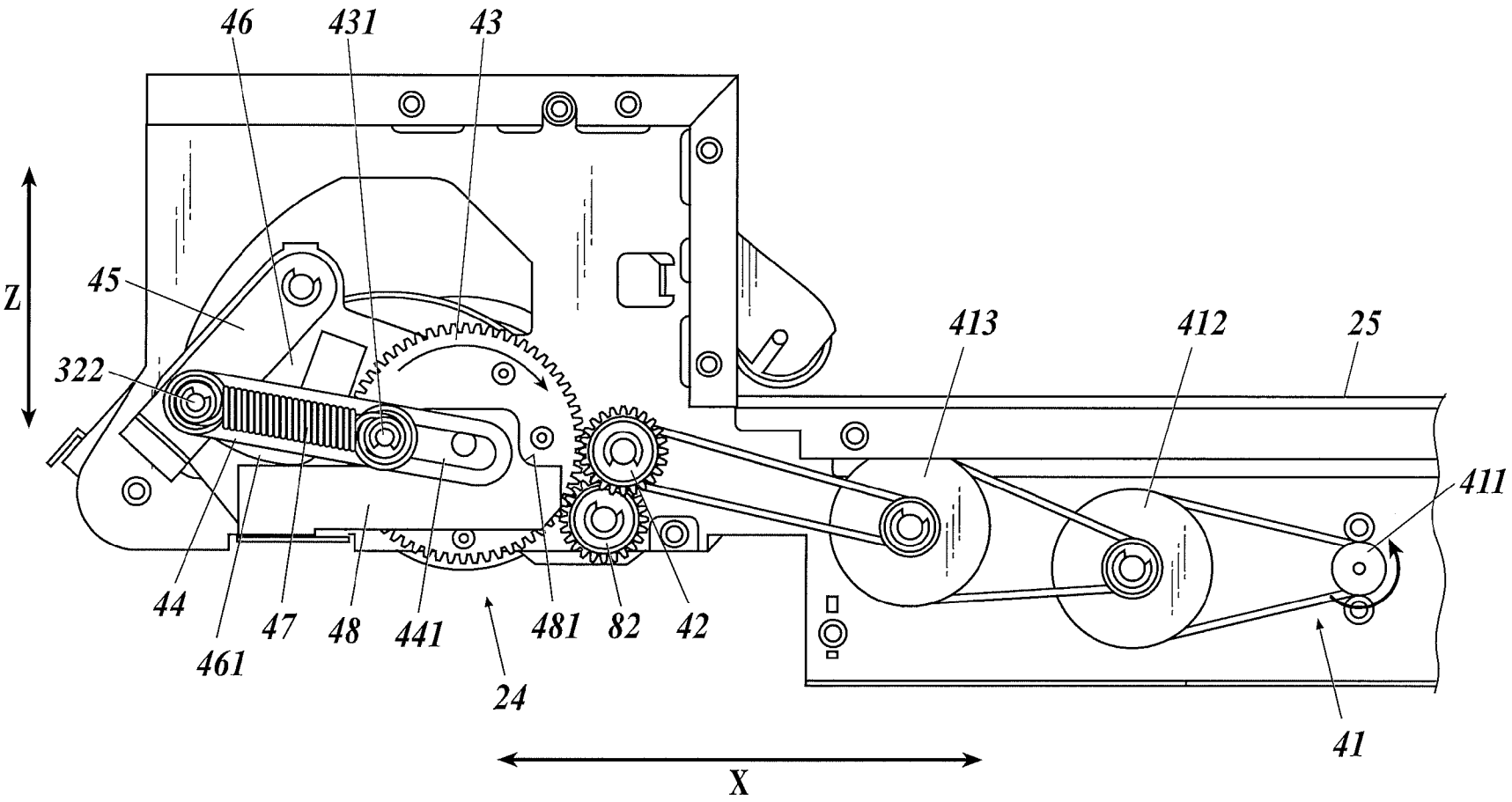
FIG. 10 is a diagram illustrating ejecting operation of booklets and showing a nip release section.

FIG. 3 is a perspective view showing an overall configuration of the paper ejection section 11 in a standby state before receiving the booklet S2. FIG. 4 is a perspective view showing a part of the paper ejection section 11 in a standby state before receiving the booklet S2. FIG. 5 is a perspective view showing a part of the paper ejection section 11 in a state where the nip of the booklet S2 is released when ejecting the booklet S2. FIG. 6 is a bottom view showing a part of the paper ejection section 11 in a standby state before receiving the booklet S2. FIG. 7 is a schematic view showing a booklet ejection section 23 and an opening and closing mechanism 22 in a standby state before receiving the booklet S2. FIG. 8 is a schematic view showing the booklet ejection section 23 and the opening and closing mechanism 22 when ejecting the booklet S2. FIG. 9 is a block diagram showing a control system of the sheet processing apparatus 4. FIG. 10 is a side view showing a nip release section 24 of the paper ejection section 11 in a standby state before receiving the booklet S2.

The paper ejection section 11 is configured to eject the booklet S2 formed by the sheet processing section 10 out of the sheet processing apparatus 4. The paper ejection section 11 includes a booklet ejection section 23 which ejects the booklet S2 outside while nipping the booklet S2, a nip release section 24 to release the nip of the booklet S2 by the booklet ejection section 23, an ejected paper stacking section 25 on which the booklet S2 ejected from the booklet ejection section 23 is stacked, a shutter section 21 which is provided between the booklet ejection section 23 and the ejected paper stacking section 25 so as to be openable and closable, an opening and closing mechanism 22 which performs opening and closing operation that is opening the shutter section 21 when the booklet S2 is ejected by the booklet ejection section 23 and closing the shutter section 21 after the booklet S2 is ejected, a booklet reaching detection section 26 which detects that the booklet S2 reached the paper ejection section 11, a nip detection section 27 which detects that the booklet S2 is nipped by the booklet ejection section 23, a booklet lift-up detection section 28 which detects that the booklet S2 nipped by the booklet ejection section 23 is lifted up to the height of the ejected paper stacking section 25, a booklet ejection detection section 29 to determine a timing to release the nip of the booklet S2, a standby position detection section 30 which detects that the booklet ejection section 23 is in a state capable of receiving the next booklet S2, and others.

The booklet ejection section 23 is configured to nip the booklet S2 which is conveyed with the folding line turned up in the nearly vertical direction and eject the booklet S2 to the ejected paper stacking section 25. The booklet S2 is directed to be nearly parallel to the YZ plane when conveyed to the booklet ejection section 23 and directed to be nearly parallel to the XY plane when ejected to the ejected paper stacking section 25 by the booklet ejection section 23.

The booklet ejection section 23 includes an ejection roller 31 which is provided on the upstream side to the ejected paper stacking section 25 in the paper conveyance direction and drives to rotate in the direction of the arrow shown in FIG. 4, a following roller 32 which nips the booklet S2 with the ejection roller 31 and a support 33 which contains a shaft 311 (see FIG. 6) supporting the ejection roller 31 and such like therein.

The support 33 is provided so as to extend in the Y direction, the upper surface thereof is formed to be curved along the circumferential surface of the ejection roller 31 and the curved surface leads to the upper surface of the ejected paper stacking section 25. The support 33 is hollow and contains the shaft 311 supporting the ejection roller 31 and others therein as shown in FIG. 6. The shaft 311 is configured to be rotatably driven by a driving unit 312 and thereby the ejection roller 31 is driven to rotate. By the ejection roller 31 being rotatably driven in a state of nipping the booklet S2 with the following roller 32, the booklet S2 can be ejected to the ejected paper stacking section 25.

The following roller 32 is supported by a shaft 321. The following roller 32 is located in a position (standby position; see FIGS. 4, 6 and 7) away from the ejection roller 31 in the X direction before the booklet S2 is conveyed to the booklet ejection section 23, and when the booklet S2 reaches the booklet ejection section 23, the following roller 32 moves to a position abutting the ejection roller 31 via the booklet S2 to nip the booklet S2 by an after-mentioned nip release section 24.

Then, the following roller 32 moves to a position above the ejection roller 31 in a state of nipping the booklet S2 by the nip release section 24. Thus, the booklet S2, which was directed to be nearly parallel to the YZ direction when reaching the booklet ejection section 23, is redirected to be nearly parallel to the XY direction. Further, before the rear end portion of the booklet S2 comes off the nip part between the ejection roller 31 and the following roller 32, the following roller 32 moves away from the ejection roller 31 to a position above the ejection roller 31 by the nip release section 24 to release the nip of the booklet S2.

The booklet ejection section 23 in such configuration is provided inside the housing 9 and ejects the booklet S2 out from the open part 91 of the housing 9.

The nip release section 24 is provided on both sides of the booklet ejection section 23 in the Y direction, respectively and configured to perform nip and nip release of the booklet S2 by the booklet ejection section 23 and lift up the booklet S2 nipped by the booklet ejection section 23. The nip release section 24 includes a driving unit 41, driving gears 42, first gears 43, first sheet metal units 44, second sheet metal units 45, fixing members 46, springs 47, shaft stoppers 48 and others. The first gears 43, the first sheet metal units 44, the second sheet metal units 45, the fixing members 46, the springs 47, the shaft stoppers 48 and the driving gears 42 are provided on respective sides of the booklet ejection section 23 in the Y direction, and the driving unit 41 is provided on one of the sides of the booklet ejection section 23.

At each of the sides of the booklet ejection section 23, the driving unit 41 includes a driving motor 411 and pulleys 412 and 413 which are joined to the motor shaft of the driving motor 411 via belts and rotate by the rotary drive of the driving motor 411. The pulley 413 rotates the driving gear 42 via a belt. The driving motor 411 is configured to be rotatable in both forward and backward directions.

The driving gear 42 is located so as to be engaged with the first gear 43 and the first gear 43 rotates by the driving gear 42 being rotated by the driving unit 41.

A long hole 441 is provided in one end portion of the first sheet metal unit 44 so as to go through in the thickness direction and extend in the length direction of the first sheet metal unit 44, and a gear fixing shaft 431 fixed on a side surface of the first gear 43 is located inside the long hole 441. The gear fixing shaft 431 can move in the length direction of the first sheet metal unit 44 by sliding inside the long hole 441 by the first gear 43 rotating. A shaft 321 supporting the following roller 32 is inserted through the other end portion of the first sheet metal unit 44 so that the first sheet metal unit 44 is rotatable around the shaft 321. One end portion of the second sheet metal unit 45 is attached to the fixing member 46 so as to be rotatable. The shaft 321 is inserted through the other end portion of the second sheet metal unit 45 so that the second sheet metal unit 45 is rotatable around the shaft 321. The spring 47 joins the gear fixing shaft 431 and the end portion 322 of the shaft 321.

The fixing member 46 supports the end portion of the second sheet metal unit 45 so as to be rotatable and is fixed to the shaft stopper 48. The shaft 321 is inserted through the fixing member 46 and the fixing member 46 is provided with a hole part 461 shaped so that the shaft 321 can move toward the ejection roller 31. Thus, by the shaft 321 which is inserted through the other end portion of the second sheet metal unit 45 moving inside the hole part 461, the second sheet metal unit 45 can rotate around the end portion side thereof as a supporting point which is supported by the fixing member 46.

The shaft stopper 48 is provided along the side surface of the first gear 43 coaxially and configured so that the gear fixing shaft 431 abuts the first abutting part 481 or the second abutting part 482 of the shaft stopper 48 when the first gear 43 rotates forward or backward. When the first gear 43 further rotates in the same direction in a state where the gear fixing shaft 431 abuts the first abutting part 481 or the second abutting part 482, the shaft stopper 48 rotates by being pushed by the gear fixing shaft 431, and the fixing member 46, the first sheet metal unit 44, the second sheet metal unit 45 and such like rotate in conjunction with the shaft stopper 48.

By such configuration of the nip release section 24, the first gear 43 rotates in the arrow direction in FIGS. 4 and 10 by the driving unit 41, the gear fixing shaft 431 moves along the arrow direction, the first sheet metal unit 44 moves with the gear fixing shaft 431, and the shaft 321 inserted through the first sheet metal unit 44 and the following roller 32 supported by the shaft 321 move toward the ejection roller 31. Thus, the following roller 32 which was away before receiving the booklet S2 moves toward the ejection roller 31. Further, by the gear fixing shaft 431 moving, the spring 47 provided between the end portion 322 of the shaft 321 and the gear fixing shaft 431 is extended and the following roller 32 supported by the shaft 321 nips the booklet S2 with the ejection roller 31 by the elastic force of the spring 47. By further rotating the first gear 43 in the same direction by the driving unit 41, the gear fixing shaft 431 abuts the first abutting part 481 and the shaft stopper 48 rotates. By the fixing member 46, the first sheet metal unit 44 and the second sheet metal unit 45 rotating in conjunction with the shaft stopper 48, the shaft 321 is lifted above the ejection roller 31 and the following roller 32 supported by the shaft 321 is located above the ejection roller 31 in a state of nipping the booklet S2 with the ejection roller 31. Thus, the nip release section 24 can lift the booklet S2 above the ejection roller 31.

After lifting up the booklet S2, by the nip release section 24 rotating the first gear 43 backward by the driving unit 41, the gear fixing shaft 431 moves along the backward rotation direction of the first gear 43, the first sheet metal unit 44 moves with the gear fixing shaft 431, and the shaft 321 and the following roller 32 move away from the ejection roller 31 (see FIG. 5). Thus, the nip between the ejection roller 31 and the following roller 32 can be released.

The ejected paper stacking section 25 is a member which is provided in a nearly horizontal direction to receive and stack a plurality of the booklets S2 ejected through the open part 91 by the booklet ejection section 23. The ejected paper stacking section 25 is provided with a stacking sensor 51 which detects that more than predetermined number of booklets are stacked on the ejected paper stacking section 25.

The shutter section 21 is provided between the booklet ejection section 23 and the ejected paper stacking section 25 in the X direction and attached near the open part 91 of the housing 9 so as to be movable upward and downward. The shutter section 21 is configured by including a wall part 211 covering the booklet ejection section 23 exposed at the open part 91, a guided member 212 provided on both end portions in the Y direction of the wall part 211, a shaft 213 which is provided on the lower end portion of the wall part 211 and extends in the Y direction and a booklet feed roller 214 supported at the central portion in the length direction of the shaft 213 so as to be rotatable. A guide section 92 is provided so as to extend in the Z direction near both ends in the Y direction of the open part 91 of the housing 9. The shutter section 21 can move upward and downward along the guide sections 92 by attaching the guided member 212 to the guide sections 92. By the shutter section 21 moving upward, the booklet ejection section 23 becomes exposed (open state) at the open part 91, and by the shutter section 21 moving downward, the wall part 211 covers the booklet ejection section 23 (closed state).

When the shutter section 21 is in the closed state, the booklet feed roller 214 abuts and follows the ejection roller 31. Thus, when the shutter section 21 is in the closed state, in a case where the rear end portion in the conveyance direction of the booklet S2 does not reach the ejected paper stacking section 25, the booklet feed roller 214 can feed out the booklet S2 to downstream side in the conveyance direction by sandwiching the booklet S2 with the ejection roller 31.

The opening and closing mechanism 22 opens and closes the shutter section in conjunction with the operation of the booklet ejection section 23 by the nip release section 24. The opening and closing mechanism 22 in the embodiment is provided between the support 33 and the fixing member 46 near each of the end portions in the Y direction of the support 33, and the opening and closing mechanism 22 is configured by including a cam 221 fixed on the shaft stopper 48 and a cam follower 222 which is provided on the lower end portion of the guided member 212 of the shutter section 21 and abuts the cam 221.

The cam 221 is fixed coaxially with the shaft stopper 48 and configured so as to rotate with the shaft stopper 48. Thus, the cam 221 operates in accordance with the drive of the booklet ejection section 23. A cam surface 221*a* is formed at the edge portion of the cam 221 and the cam follower 222 abuts the cam surface 221*a*. The cam surface 221*a* is formed so as to be gradually farther from the rotation axis of the cam 221 from one end portion 221*b* to the other end portion 221*c*. When the paper ejection section 11 is in the standby state, the cam 221 is located at a position where the end portion 221*b* of the cam surface 221*a* abuts the cam follower 222.

Since the cam follower 222 is fixed on the lower end portion of the guided member 212 of the shutter section 21, when the cam follower 222 moves upward and downward, the shutter section 21 also moves upward and downward. The cam follower 222 slidably contacts the cam 221.

The opening and closing mechanism 22 is configured as described above, and by the gear fixing shaft 431 of the first gear 43 abutting the first abutting part 481 and rotating by the driving unit 41, the cam 221 rotates with the shaft stopper 48. By the cam 221 rotating, the abutting position between the cam 221 and the cam follower 222 changes from the end portion 221*b* to the other end portion 221*c*. Thus, the cam follower 222 abutting the cam surface 221*a* is pushed up by the cam 221 while sliding on the cam surface 221*a*, and the shutter section 21 fixed on the cam followers 222 is pushed up. Thus, the opening and closing mechanism 22 opens the shutter section 21.

When the nip of the booklet S2 is released by the nip release section 24, the gear fixing shaft 431 of the first gear 43 abuts the second abutting part 482 and rotates backward by the driving unit 41, and thereby the cam 221 rotates backward with the shaft stopper 48. By the backward rotation of the cam 221, the abutting position between the cam 221 and the cam follower 222 changes from the other end portion 221*c* to the one end portion 221*b*. Thus, the cam follower 222 abutting the cam surface 221*a* gradually slides down the cam surface 221*a* and the shutter section 21 fixed on the cam follower 222 goes down. Thus, the opening and closing mechanism 22 closes the shutter section 21.

Even after the shutter section 21 is closed by the opening and closing mechanism 22, when the weight of the booklet S2 is large, for example, the conveyance direction rear end portion of the booklet S2 sometimes does not reach the ejected paper stacking section 25. In such case, the booklet feed roller 214 provided on the lower end portion of the shutter section 21 pushes the booklet S2 from above against the ejection roller 31. Thus, it is possible to prevent the disturbance of ejection of the booklet S2 by the shutter section 21 and eject the booklet S2 effectively even when the weight of the booklet S2 is large because the booklet S2 is pushed against the ejection roller 31 by the weight of the shutter section 21.

An elastic member connecting the lower end portion of the guided member 212 with the lower end surface of the guide section 92 may be provided near the open part 91 of the housing 9. In such case, the shutter section 21 is biased downward by the elastic force of the elastic member when the cam 221 is in the standby state, and the shutter section 21 can be surely maintained to be in the closed state. Also, by the elastic force of the elastic member, the booklet feed roller 214 of the shutter section 21 strongly sandwiches the booklet S2 with the ejection roller 31 and the booklet S2 can be ejected by the ejection roller 31 more effectively.

The elastic member may be provided so as to join the upper end portion of the guided member 212 with the upper end portion of the guide section 92.

The booklet reaching detection section 26 is contained in the support 33 of the booklet ejection section 23. The booklet reaching detection section 26 is a non-contact optical sensor, for example, and detects that the booklet S2 reached between the following roller 32 and the ejection roller 31 located at the standby position.

The nip detection section 27 is provided near the first gear 43 of the nip release section 24. The nip detection section 27 is a non-contact optical sensor, for example, and detects that the gear fixing shaft 431 of the first gear 43 abuts the first abutting part 481 of the shaft stopper 48. When the gear fixing shaft 431 abuts the first abutting part 481, the first sheet metal unit 44 is moved toward the ejected paper stacking section 25 and the shaft 321 is drawn toward the ejection roller 31 by the elastic force of the spring 47. Thus, the nip detection section 27 can detect that the following roller 32 supported by the shaft 321 nips the booklet S2 with the ejection roller 31.

The booklet lift-up detection section 28 is configured by including second gears 81 located next to the first gears 43 of the nip release section 24, following gears 82 engaged with the second gears 81, a rotation shaft 83 which is fixed on the following gears 82 and located in the support 33, an optical sensor 84 which detects the protruding part 831 formed on the circumferential surface of the rotation shaft 83, and others.

Each of the second gears 81 is configured to rotate in conjunction with the rotation operation of the shaft stopper 48. The gear fixing shaft 431 of the first gear 43 rotating by the driving unit 41 abuts the shaft stopper 48, and by the shaft stopper 48 rotating, the second gear 81 rotates. When the second gear 81 rotates, the following gear 82 engaged with the second gear 81 rotates and the rotation shaft 83 fixed on the following gear 82 also rotates. The optical sensor 84 is located so as to sandwich the protruding part 831, which is formed on the rotation shaft 83, in the length direction of the rotation shaft 83 and can detect the protruding part 831 at two positions which are different in the rotation direction of the rotation shaft 83. The optical sensor 84 detects the rotation of the rotation shaft 83 by detecting the protruding part 831. By the rotation of the rotation shaft 83 being detected, the rotation operation of the shaft stopper 48 is detected and the lifting up of the booklet S2 is detected.

The booklet ejection detection section 29 is contained in the support 33 of the booklet ejection section 23. The booklet ejection detection section 29 is a non-contact optical sensor, for example, and detects the booklet S2 passing over the support 33.

The standby position detection section 30 is provided near the standby position of the following roller 32 before receiving the booklet S2. The standby position detection section 30 is a non-contact optical sensor, for example, and detects that the following roller 32 returns to the standby position after nip of the booklet S2 is released by the nip release section 24.

The control section 12 controls the sections of the sheet processing apparatus 4 as shown in FIG. 9. The control section 12 includes a CPU (Central Processing Unit), a RAM (Random Access Memory) and a ROM (Read Only Memory) not shown in the drawings, and performs various types of operations following various processing programs for the sheet processing apparatus 4.

Figure 11:
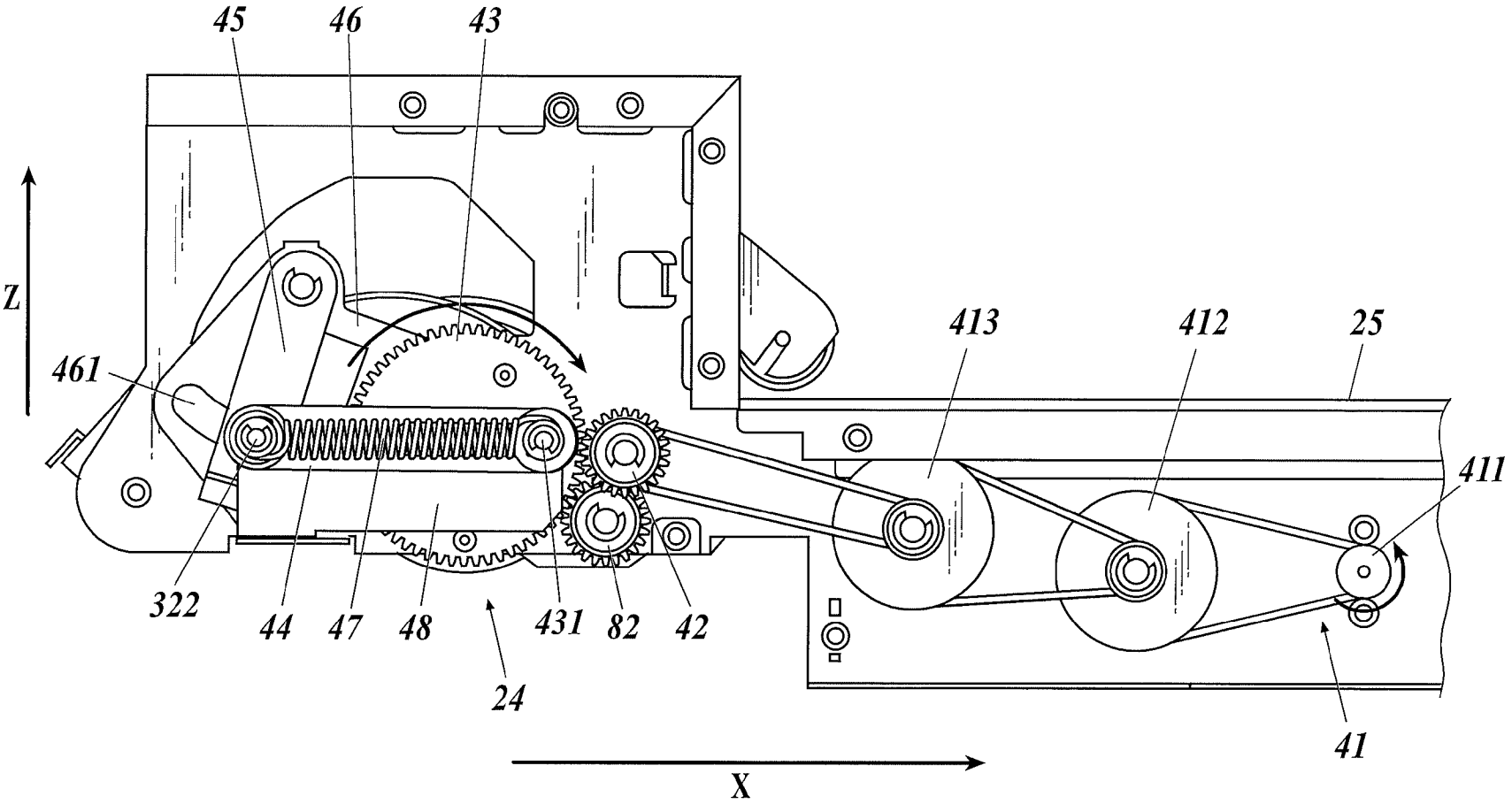
FIG. 11 is a diagram illustrating ejecting operation of booklets and showing a nip release section.
Figure 12:
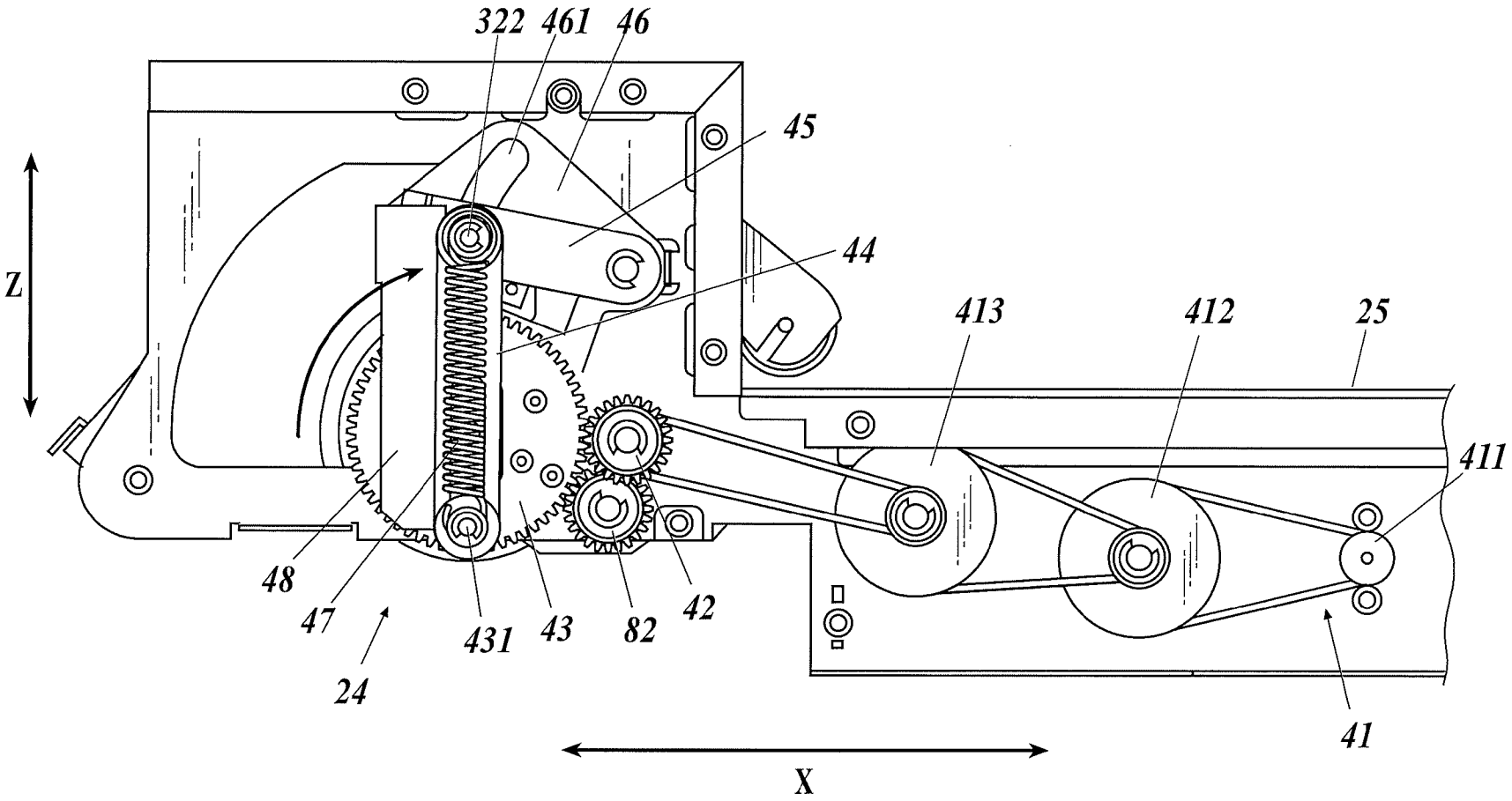
FIG. 12 is a diagram illustrating ejecting operation of booklets and showing a nip release section.
Figure 13:
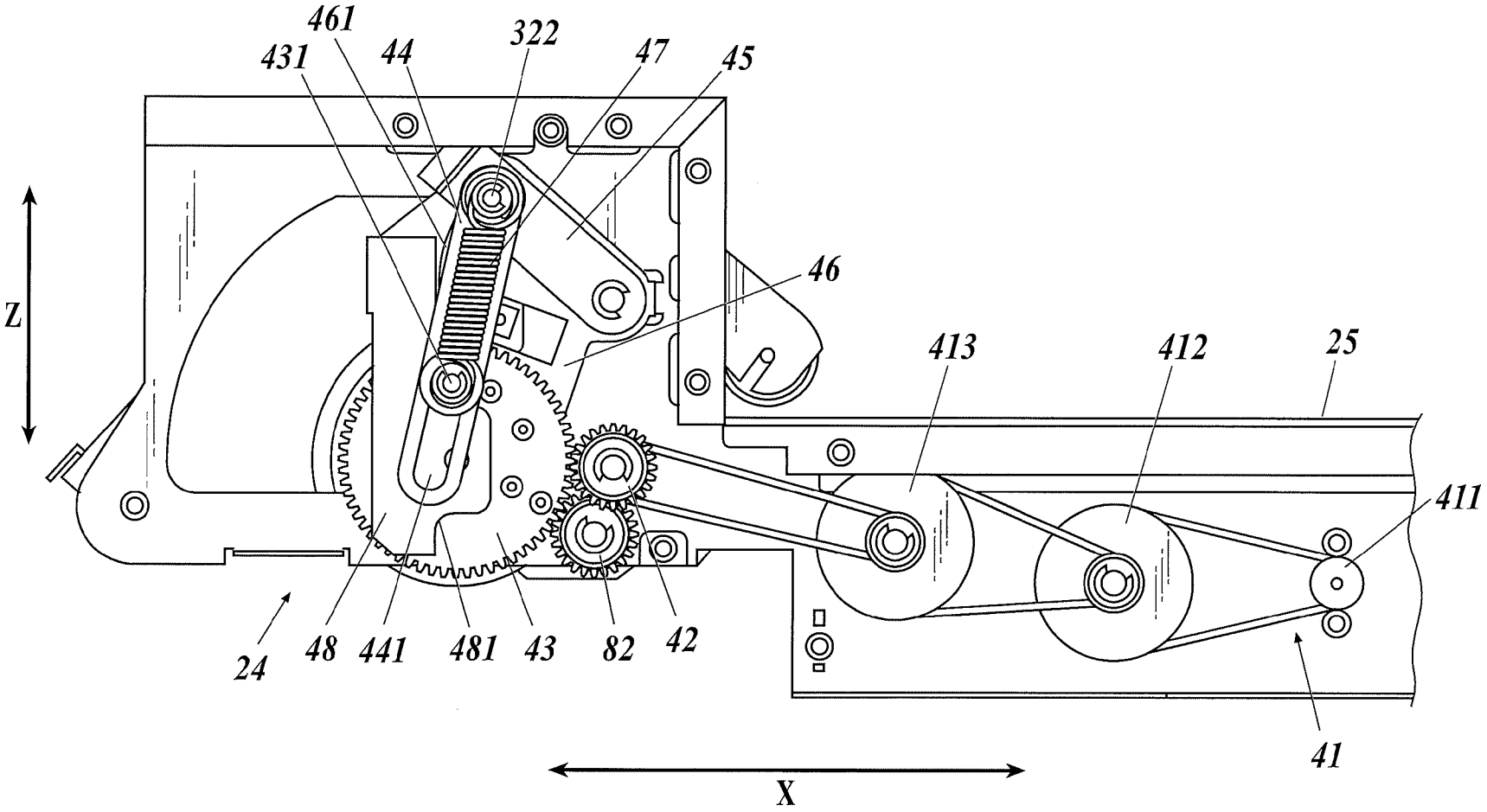
FIG. 13 is a diagram illustrating ejecting operation of booklets and showing a nip release section.
Figure 14A:
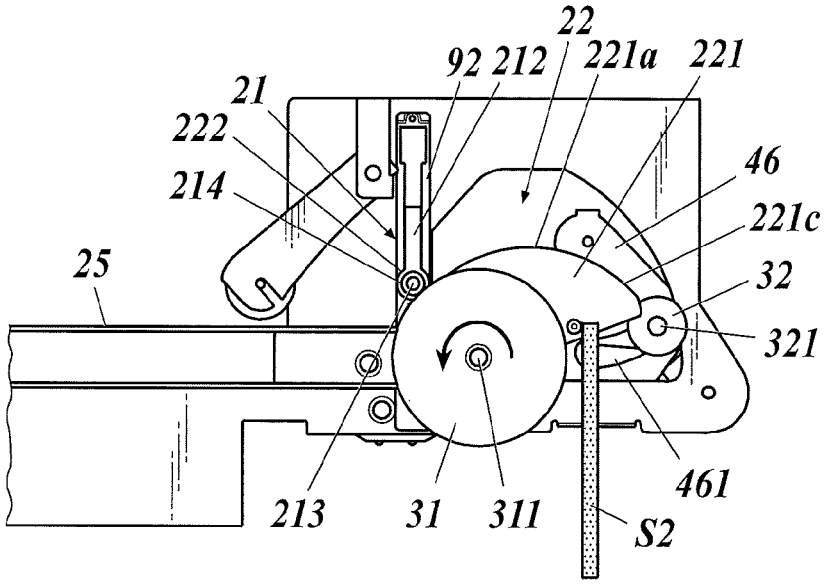
FIGS. 14A to 14C are diagrams illustrating ejecting operation of booklets and showing a booklet ejection section and an opening and closing mechanism.
Figure 14B:
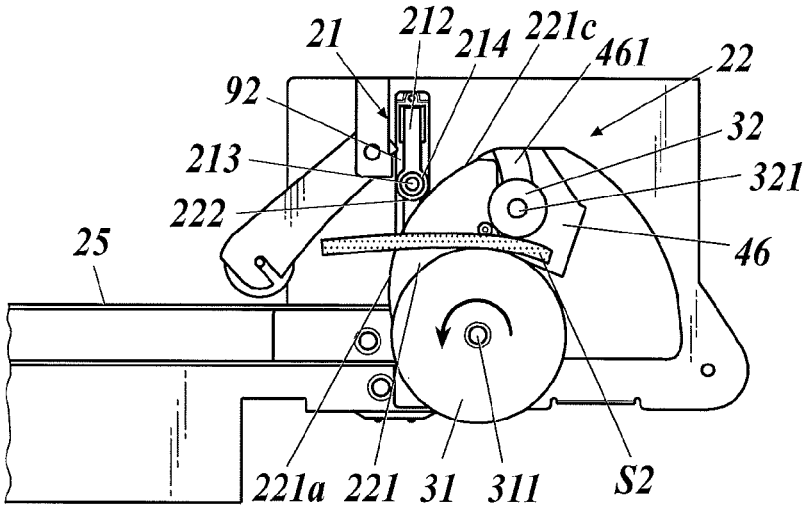
Figure 14C:
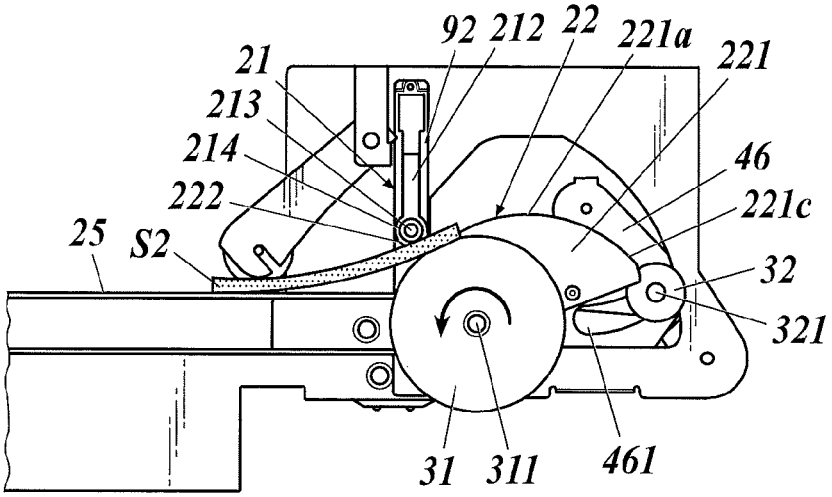

Here, operations of ejecting the booklet S2 out of the apparatus by the sheet processing apparatus 4 configured as described above will be described with reference to FIGS. 3 to 8 and 10 to 14. FIG. 11 is a side view showing the nip release section 24 of the paper ejection section 11 in a state of receiving and nipping the booklet S2. FIG. 12 is a side view showing the nip release section 24 of the paper ejection section 11 in a state of lifting up the nipped booklet S2 to the height of the ejected paper stacking section 25. FIG. 13 is a side view showing the nip release section 24 of the paper ejection section 11 in a state of releasing nip of the booklet S2 after lifting up the booklet S2 to the height of the ejected paper stacking section 25. FIG. 14 are diagrams illustrating ejection operations of the booklet S2. FIG. 14A shows the booklet ejection section 23 and the opening and closing mechanism 22 in the standby state before receiving the booklet S2, FIG. 14B shows the booklet ejection section 23 and the opening and closing mechanism 22 when lifting up the nipped booklet S2 to the height of the ejected paper stacking section 25 to eject the booklet S2 and FIG. 14C shows the booklet ejection section 23 and the opening and closing mechanism 22 releasing the nip of the booklet S2 to return to the standby state.

Before the booklet S2 is conveyed to the paper ejection section 11, the paper ejection section 11 is in the standby state and the following roller 32 is located in the standby state away from the ejection roller 31 (see FIGS. 4 and 10). At that time, at each of the sides of the booklet ejection section 23, the gear fixing shaft 431 of the first gear 43 is located at the position away from the ejected paper stacking section 25 in the X direction and the spring 47 connecting the gear fixing shaft 431 and the end portion 322 is compressed. The cam follower 222 abuts the end portion 221*b* of the cam 221 and the shutter section 21 is closed.

Then, the booklet S2 is conveyed to the paper ejection section 11 (see FIGS. 7 and 14A), and when the booklet reaching detection section 26 detects that the booklet S2 reached between the following roller 32 and the ejection roller 31 in the standby position, the control section 12 rotates the first gear 43 toward the arrow direction shown in FIG. 10 by the driving unit 41. When the first gear 43 is rotated toward the arrow direction in FIG. 10, the first sheet metal unit 44 is drawn while the gear fixing shaft 431 is sliding inside the long hole 441 and the shaft 321 inserted through the first sheet metal unit 44 and the following roller 32 supported by the shaft 321 approach the ejection roller 31.

When the control section 12 rotates the first gear 43, as shown in FIG. 11, the gear fixing shaft 431 moves toward the ejected paper stacking section 25 in the X direction and the following roller 32 abuts the ejection roller 31 via the booklet S2. When the control section 12 further rotates the first gear 43 in the same direction, the spring 47 connecting the gear fixing shaft 431 and the end portion 322 becomes extended, the end portion 322 is drawn toward the gear fixing shaft 431 by the elastic force of the spring 47 and the following roller 32 and the ejection roller 31 nip the booklet S2 therebetween.

Next, when the control section 12 further rotates the first gear 43 in the same direction (the arrow direction shown in FIG. 11), the gear fixing shaft 431 abuts the first abutting part 481 of the shaft stopper 48 and the shaft stopper 48 rotates with the first gear 43. At that time, by the nip detection section 27 detecting that the gear fixing shaft 431 abuts the first abutting part 481 of the shaft stopper 48, the following roller 32 is detected nipping the booklet S2 with the ejection roller 31 and the control section 12 releases the support of the booklet S2 by the conveyance unit (not shown in the drawings) which is provided under the paper ejection section 11.

The fixing member 46 and the cam 221 are fixed on the shaft stopper 48 and, in accordance with the rotation of the shaft stopper 48, the fixing member 46, the cam 221 and the first sheet metal unit 44 and the second sheet metal unit 45 attached to the fixing member 46 rotate. Thus, the shaft 321 inserted through the first sheet metal unit 44 and the following roller 32 supported by the shaft 321 move upward to the arrow direction shown in FIG. 12 along the circumferential surface of the ejection roller 31 while nipping the booklet S2 with the ejection roller 31, the booklet S2 is lifted up to the approximately same height of the ejected paper stacking section 25 and the direction of the booklet S2 is changed (see FIG. 8). Also, by the cam 221 rotating, the cam follower 222 abutting the end portion 221*b* of the cam surface 221*a* slides on the cam surface 221*a* to be pushed up to the position of abutting the end portion 221*c* and the shutter section 21 fixed on the cam follower 222 is also pushed up. Thus, the shutter section 21 is opened (FIG. 14B).

Further, by the shaft stopper 48 rotating, the second gear 81 fixed on the shaft stopper 48 rotates and the following gear 82 engaged with the second gear 81 rotates. When the following gear 82 rotates, the protruding part 831 of the rotation shaft 83 fixed on the following gear 82 rotates and the optical sensor 84 detects that the protruding part 831 rotates. Thus, the booklet S2 is detected being lifted up and the control section 12 stops the rotation operation of the first gear 43 by the driving unit 41 and starts the rotation operation of the ejection roller 31 by the driving unit 312.

By the rotation drive of the ejection roller 31, the booklet S2 nipped between the ejection roller 31 and the following roller 32 moves toward the ejected paper stacking section 25 and the control section 12 releases the nip of the booklet S2 by the nip release section 24 on the basis of the timing at which the booklet S2 is detected by the booklet ejection detection section 29.

Specifically, on the basis of the timing at which the booklet S2 is detected by the booklet ejection detection section 29, the control section 12 rotates the driving motor 411 of the nip release section 24 backward to rotate the first gear 43 backward. When the control section 12 rotates the first gear 43 backward, the gear fixing shaft 431 moves along the backward rotation direction of the first gear 43 to approach the end portion 322. The spring 47 becomes compressed when the gear fixing shaft 431 moves and the nip between the following roller 32 and the ejection roller 31 is released. At the same time, the gear fixing shaft 431 moves by sliding inside the long hole 441 and lifts up the first sheet metal unit 44. By the first sheet metal unit 44 being lifted up, the following roller 32 moves away from the ejection roller 31 (see FIGS. 5 and 13). Thus, the nip of the booklet S2 is released by the nip release section 24. The shaft stopper 48 does not rotate during nip release operation by the nip release section 24.

Next, when the control section 12 further rotates the first gear 43 backward, the gear fixing shaft 431 abuts the second abutting part 482 of the shaft stopper 48 and the shaft stopper 48 rotates backward with the first gear 43. In accordance with the backward rotation of the shaft stopper 48, the fixing member 46, the cam 221 and the first sheet metal unit 44 and the second sheet metal unit 45 attached to the fixing member 46 rotate backward. Thus, the shaft 321 inserted through the first sheet metal unit 44 and the following roller 32 supported by the shaft 321 move toward the lateral side of the ejection roller 31 away from the ejection roller 31 and returns to the standby position (see FIGS. 4, 9 and 14C). Also, as shown in FIG. 14C, by the cam 221 rotating backward, the cam follower 222 abutting the end portion 221*c* of the cam surface 221*a* slides on the cam surface 221*a* to move downward to the position abutting the end portion 221*b* and the shutter section 21 fixed on the cam follower 222 also moves downward. Thus, the shutter section 21 is closed. Further, even after the shutter section 21 is closed, when the conveyance direction rear end portion of the booklet S2 does not reach the ejected paper stacking section 25 due to the large weight of the booklet S2 or such like, the shutter section 21, by its own weight, pushes the booklet feed roller 214 against the upper surface of the booklet S2, and by pushing the booklet S2 against the circumferential surface of the ejection roller 31, ejects the booklet S2 by the rotation drive of the ejection roller 31. Then, the standby position detection section 30 detects that the following roller 32 returns to the standby position and the control section 12 conveys the next booklet S2 to the paper ejection section 11 by the conveyance unit.

The sheet processing apparatus 4 ejects out the booklet S2 as described above.

As described above, according to the embodiment, the openable and closable shutter section 21 is provided between the booklet ejection section 23 and the ejected paper stacking section 25, the shutter section 21 is opened by the opening and closing mechanism 22 when ejecting the booklet S2 by the booklet ejection section 23 and the shutter section 21 is closed after the booklet S2 is ejected. Therefore, the entrance of foreign objects into the booklet ejection section 23 can be prevented except when the booklet S2 is ejected. Thus, the damage of the apparatus and wrong operations caused by the entrance of foreign objects into the apparatus can be prevented.

Further, since the booklet feed roller 214 is provided at the lower end portion of the shutter section 21, after the shutter section 21 is closed, when the conveyance direction rear end portion of the booklet S2 does not reach the ejected paper stacking section 25, the booklet feed roller 214 pushes the booklet S2. Thus, being sandwiched between the booklet ejection section 23 and the booklet feed roller 214, the booklet S2 can be ejected effectively.

Since the opening and closing mechanism 22 opens and closes the shutter section 21 in conjunction with the driving of the booklet ejection section 23 by the nip release section 24, the entrance of foreign objects into the booklet ejection section 23 can be prevented in the simple configuration.

Though the opening and closing mechanism is configured to operate in conjunction with the driving of the booklet ejection section by the nip release section and the shutter section is opened and closed by this configuration in the above embodiment, the present invention is not limited to this. The opening and closing mechanism may be configured to open and close the shutter section by electronic control. Specifically, the opening and closing mechanism may be configured by including a driving section such as a motor, a gear and solenoid which drives the shutter section, a detection section which detects ejection of the booklet and a control section which drives the shutter section by the driving section to perform opening and closing operation on the basis of the timing at which the ejection of booklet is detected by the detection section. In such case, a detection section included in the opening and closing mechanism may be the nip detection section, booklet lift-up detection section, the booklet ejection detection section or such like and a control section included in the opening and closing mechanism may be the control section in the above embodiment.

Though the booklet feed roller is provided at the lower end portion of the shutter section in the above embodiment, the shutter section may not be provided with the booklet feed roller. In such case, a configuration preventing disturbance of booklet ejection by the shutter section and a configuration preventing the booklet from being damaged or bended by the lower end portion of the shutter section abutting the booklet are preferable.

Though the nip release section nips the booklet, releases the nip and lifts up the booklet in the above embodiment, each of the operations may be performed by a different mechanism. Further, the nip release section is not limited to the above-described configuration and may have any configuration as long as the nip release section can nip the booklet, release the nip, lift up the booklet and such like.

Though the paper ejection section ejects booklets formed by the sheet processing section in the above embodiment, the paper ejection section is not limited to this and may eject sheets as they are.

What is claimed is:

1. A sheet processing apparatus for use with a booklet, comprising:

a sheet processing section which performs predetermined processing on a sheet of paper to form the booklet;

a booklet ejection section which nips the booklet and ejects the booklet outside;

an ejected paper stacking section on which the booklet ejected by the booklet ejection section is stacked;

a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected, wherein the opening and closing mechanism performs the opening and closing operation of the shutter section in conjunction with a movement of the booklet ejected by the booklet ejection section;

wherein the opening and closing mechanism and the booklet ejection section are mechanically-coupled, and the opening and closing mechanism performs the opening and closing operation in conjunction with drive of the booklet ejection section; and wherein the opening and closing mechanism includes a cam which operates in accordance with the drive of the booklet ejection section and a cam follower which is fixed on the shutter section and slidably contacts with the cam, and the opening and closing operation is performed by the cam follower sliding on the cam following the operation of the cam.

2. The sheet processing apparatus according to claim 1, wherein the opening and closing mechanism closes the shutter section between the ejection of a certain booklet and the ejection of the next booklet.

3. The sheet processing apparatus according to claim 1, further comprising:

a conveyance unit which is provided under the booklet ejection section and conveys the booklet to the booklet ejection section in a state of a folding line being turned up in a nearly vertical direction.

4. A sheet processing apparatus for use with a booklet, comprising:

a sheet processing section which performs predetermined processing on a sheet of paper to form the booklet;

a booklet ejection section which nips the booklet and ejects the booklet outside;

an ejected paper stacking section on which the booklet ejected by the booklet ejection section is stacked;

a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected, wherein the shutter section includes a booklet feed roller which abuts an upper surface of the booklet ejected from the booklet ejection section and pushes the booklet.

5. A sheet processing apparatus for use with a booklet, comprising:

a sheet processing section which performs predetermined processing on a sheet of paper to form the booklet;

a booklet ejection section which nips the booklet and ejects the booklet outside;

an ejected paper stacking section on which the booklet ejected by the booklet ejection section is stacked;

a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected, wherein the opening and closing mechanism includes a driving section which drives the shutter section, a detection section which detects ejection of the booklet and a control section which performs the opening and closing operation by driving the shutter section with the driving section on the basis of a timing at which ejection of the booklet is detected by the detection section.

6. An image forming system for use with a booklet, comprising:

an image forming apparatus which forms an image on a sheet of paper; and a sheet processing apparatus structured to perform predetermined processing on the sheet on which the image is formed by the image forming apparatus, the sheet processing apparatus comprising:

a sheet processing section which performs predetermined processing on a sheet of paper to form the booklet;

a booklet ejection section which nips the booklet and ejects the booklet outside;

an ejected paper stacking section on which the booklet ejected by the booklet ejection section is stacked;

a shutter section which is provided between the booklet ejection section and the ejected paper stacking section and is openable and closable; and an opening and closing mechanism which performs an opening and closing operation that is opening the shutter section when the booklet is ejected by the booklet ejection section and closing the shutter section after the booklet is ejected, wherein the opening and closing mechanism performs the opening and closing operation of the shutter section in conjunction with a movement of the booklet ejected by the booklet ejection section;

wherein the opening and closing mechanism and the booklet ejection section are mechanically-coupled, and the opening and closing mechanism performs the opening and closing operation in conjunction with drive of the booklet ejection section; and wherein, the opening and closing mechanism includes a cam which operates in accordance with the drive of the booklet ejection section and a cam follower which is fixed on the shutter section and slidably contacts with the cam, and the opening and closing operation is performed by the cam follower sliding on the cam following the operation of the cam.

* * * * *